US005793152A

United States Patent [19]

Tang et al.

[11] Patent Number: 5,793,152

[45] Date of Patent: Aug. 11, 1998

[54] GATED FIELD-EMITTERS WITH INTEGRATED PLANAR LENSES

[75] Inventors: Cha-Mei Tang, Potomac, Md.; Thomas A. Swyden, Falls Church, Va.

[73] Assignees: Frederick M. Mako, Fairfax Station, Va.; Ansel M. Schwartz, Pittsburgh, Pa.

[21] Appl. No.: 161,667

[22] Filed: Dec. 3, 1993

[51] Int. Cl.[6] ..... H01J 19/24

[52] U.S. Cl. ..... 313/306; 313/336

[58] Field of Search ..... 313/306, 308, 313/309, 311, 336, 351, 355

[56] References Cited

U.S. PATENT DOCUMENTS

| | | | |
|---|---|---|---|
| 4,712,039 | 12/1987 | Hong | 313/307 |
| 4,874,981 | 10/1989 | Spindt | 313/309 |
| 5,140,219 | 8/1992 | Kane | 313/495 |
| 5,173,634 | 12/1992 | Kane | 313/306 |
| 5,191,217 | 3/1993 | Kane et al. | 250/423 F |
| 5,235,244 | 8/1993 | Spindt | 313/495 |
| 5,245,247 | 9/1993 | Hosogi | 313/309 |
| 5,359,256 | 10/1994 | Gray | 313/169 |

*Primary Examiner*—Mark R. Powell
*Attorney, Agent, or Firm*—Ansel M. Schwartz

[57] ABSTRACT

The present invention is a device for producing collimated electron beams. The device comprises a gated field emission array having at least one emission tip and a grid electrode having a grid opening disposed above the emission tip in a first direction. The device also comprises an integrated planar lens electrode for producing a focusing effect on electron beams emitted by the emission tip. The planar lens electrode has a lens edge disposed aside at a distance from the grid opening in a second direction perpendicular to the first direction. Preferably, the planar lens electrode is an integrated layer with the gated field emission array on a substrate. The grid electrode and the lens electrode can be on the same layer and separated by a gap of vacuum. The planar lens electrode can be above the grid electrode, separated by an insulative material. Similarly, the planar lens electrode can be below the grid electrode, and separated by an insulator material. Sometimes, the base electrode on which the tips are formed can act as a lens.

14 Claims, 13 Drawing Sheets

GATED FIELD-EMITTERS WITH INTEGRATED PLANAR LENSES

FIELD OF THE INVENTION

The present invention is related in general to electrical devices. More specifically, the present invention is related to a lens construction for gated field emission arrays.

BACKGROUND OF THE INVENTION

Gated cathodes in the form of field emitting arrays (FEAs) were proposed by C. A. Spindt, I. Brodie, L. Humphrey and E. R. Westerberg (C. A. Spindt, I. Brodie, L. Humphrey and E. R. Westerberg, "Physical Properties of Thin-Film Field Emission Cathodes with Molybdenum Cones", J. Appl. Phys. 47, 5248 (1976)). Emission is turned on or off by varying the voltage of the grid electrode. Fabrication using a variety of techniques has been demonstrated. For example, FEAs can now be fabricated on silicon wafers using lithographic techniques.

The electrons emerging from an emission tip of a gated FEA typically have a significant angular spread, as shown in FIG. 1. If an anode at 5500 volts were placed at a distance of 525 μm from the grid of such an emitting tip, the radius of the final electron spot would be about 55 μm. Such an anode-to-grid configuration is typical of flat panel display applications using high-voltage phosphors. In order to prevent cross-talk between the pixels of a flat panel display using FEAs, each FEA would have to be smaller than its corresponding pixel by a boundary strip 55 μm wide. For many applications requiring high resolution (and thus small pixel size), such a restriction would leave little, if any, room for the FEA.

Many simulations (C. M. Tang, A. C. Ting and T. Swyden, "Field-Emission Arrays—A Potentially Bright Source", Nucl. Instr. and Meth. A318, 353 (1992); W. B. Herrmannsfeldt, R. Becker, I. Brodie, A. Rosengreen and C. A. Spindt, Nucl. Instr. and Meth. A298, 39 (1990); and R. M. Mobley and J. E. Boers, "Computer simulation of Micro-Triode Performance", IEEE Trans. on Electron Devices, 38, 2383 (1991)) showing nearly collimated beams from FEAs were performed, using a thin lens-electrode configuration, where the voltage on the lens was lower than that of the grid and the lens opening was approximately equal to the grid opening. However, a large percentage of the emitted electrons per tip did not emerge from the lens opening. Besides striking the lens and/or the grid, they struck the insulator. The intercepted electrons were shown in (R. M. Mobley and J. E. Boers, "Computer simulation of Micro-Triode Performance", IEEE Trans. on Electron Devices, 38, 2383 (1991)), but were not shown in the figures of C. M. Tang, A. C. Ting and T. Swyden, "Field-Emission Arrays—A Potentially Bright Source", Nucl. Instr. and Meth. A318, 353 (1992) and W. B. Herrmannsfeldt, R. Becker, I. Brodie, A. Rosengreen and C. A. Spindt, Nucl. Instr. and Meth. A298, 39 (1990). Designs based on a single thin lower voltage lens are, therefore, not practical for many applications because:

i. There is significant reduction of the extracted beam current from the emitting tip.

ii. The charging of the insulator can cause breakdown.

iii. Coating of the insulator by a conducting material has been proposed as a solution to drain the charge accumulation. However, the conducting coating also provides a leakage path between the gate and the emitter. The leakage of current produces power loss.

The concept of obtaining nearly collimated beams from collimating grid FEAs is presented in the patent disclosure, "Integrated Collimating-Grid Field-Emission Arrays", by Cha-Mei Tang, Antonio C. Ting and T. A. Swyden (C. M. Tang, A. C. Ting and T. A. Swyden, "Collimating Grid Field-Emission Arrays", Navy Case No. -75,216). The opening of the grid electrode acts as the primary focusing lens for all electrons emitted from the tip, and the low voltage third electrode (in a three-electrode system) provides further collimation.

The concept of obtaining collimated beams using a thick sidewall lens is presented in the patent disclosure, "Gated Field-Emitters with Integrated Focusing Sidewall Lenses", by Cha-Mei Tang and T. A. Swyden (C. M. Tang and T. A. Swyden, "Gated Field-Emitters with Integrated Focusing Sidewall Lenses", Navy Case No. -75,312).

The primary purpose of the present invention is to produce a focusing effect along the edges of gated field-emission arrays (FEAs) by introducing a simple, low voltage lens anode around, and on the same substrate as, the FEA. Electrons emitted near the edge of an FEA having such a "planar" lens will be deflected away from the edge, resulting in a better collimated beam. These arrays will have applications in flat panel displays, as cathodes for radiation sources, as cathodes for accelerators, etc.

SUMMARY OF THE INVENTION

The present invention is a device for producing collimated electron beams. The device comprises a gated field emission array having at least one emission tip and a grid electrode having a grid opening disposed above the emission tip in a first direction.

The device also comprises an integrated planar lens electrode for producing a focusing effect on electron beams emitted by the emission tip. The planar lens electrode has a lens edge disposed aside at a distance from the grid opening in a second direction perpendicular to the first direction.

Preferably, the planar lens electrode is an integrated layer with the gated field emission array on a substrate.

The grid electrode and the lens electrode can be on the same layer and separated by a gap of vacuum. The planar lens electrode can be above the grid electrode, separated by an insulative material. Similarly, the planar lens electrode can be below the grid electrode, and separated by an insulator material. Sometimes, the base electrode on which the tips are formed can act as a lens.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
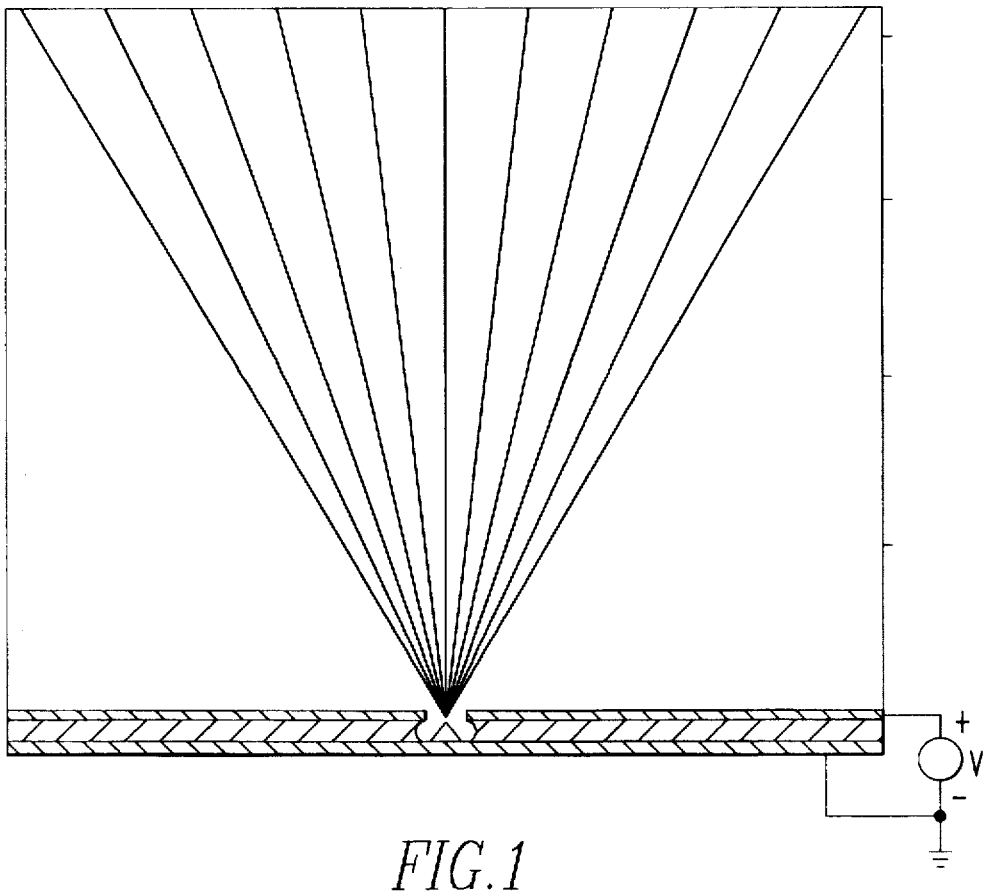
FIG. 1 PRIOR ART
FIG. 1 is a schematic representation showing electron trajectories from a gated field emission tip without focusing.
Figure 2A:
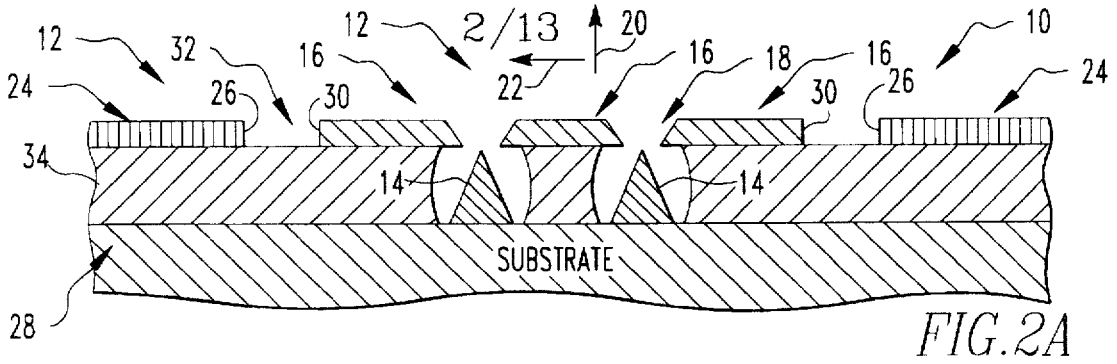
FIGS. 2*a*–2*d* are schematic representations showing various embodiments of planar lens focusing constructions for gated field emission arrays.
Figure 2B:
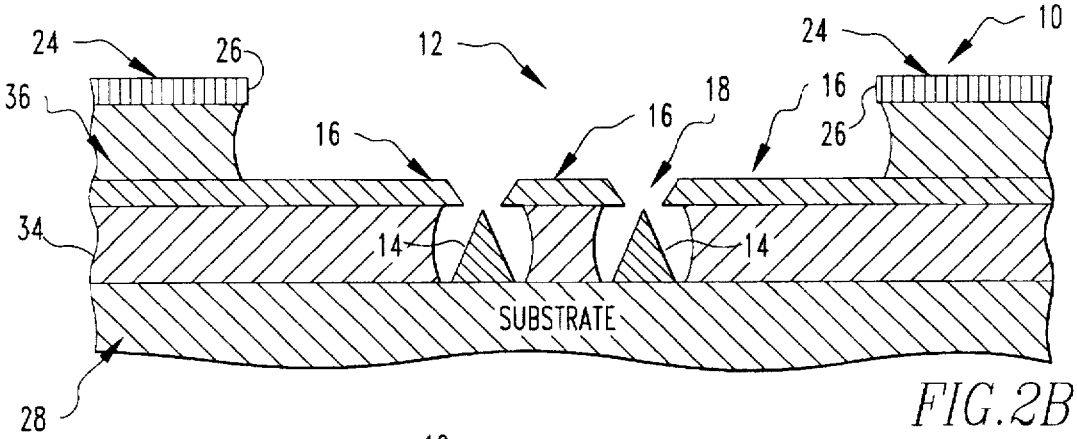
Figure 2C:
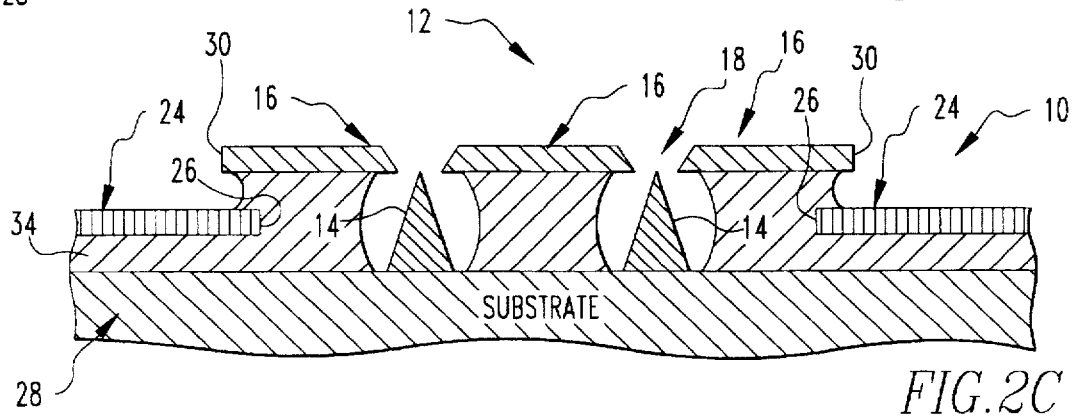

Referring now to the drawings wherein like reference numerals refer to similar or identical parts throughout the several views, and more specifically to FIGS. 2*a*–2*c* thereof, there is shown a device 10 for producing collimated electron beams. The device 10 comprises a gated field emission array 12 having at least one emission tip 14 and a grid electrode 16 having a grid opening 18 disposed above the emission tip 14 in a first direction 20.

The device 10 also comprises an integrated planar lens electrode 24 for producing a focusing effect on electron beams emitted by the emission tip 14. The planar lens electrode has a lens edge 26 disposed aside at a distance from the grid opening 18 in a second direction 22 perpendicular to the first direction 20.

Preferably, the planar lens electrode 24 is an integrated layer with the gated field emission array 12 on a substrate 28. The grid electrode can have a grid edge 30 disposed aside in a spaced relation to the grid opening 18 in the second direction 22. The lens edge 26 is disposed adjacent to the grid edge 30.

In one embodiment, as shown in FIG. 2*a*, the planar lens electrode 24 and the grid electrode 16 are disposed on the same layer such that a space 32 is formed between the grid edge 30 and the lens edge 26. The layer can comprise an insulator layer 34.

In another embodiment, and as shown in FIG. 2*b*, the planar lens electrode 24 is disposed above the grid electrode 16 relative to the first direction 20. Preferably, the planar lens electrode 24 is separated from the grid electrode 16 by an insulative layer 36.

In yet another embodiment, and as shown in FIG. 2*c*, the planar lens electrode 24 is disposed below the grid electrode 16 relative to the first direction 20. For instance, the planar lens electrode 24 separated from the grid electrode 16 by an insulator layer 34.

Figure 3A:
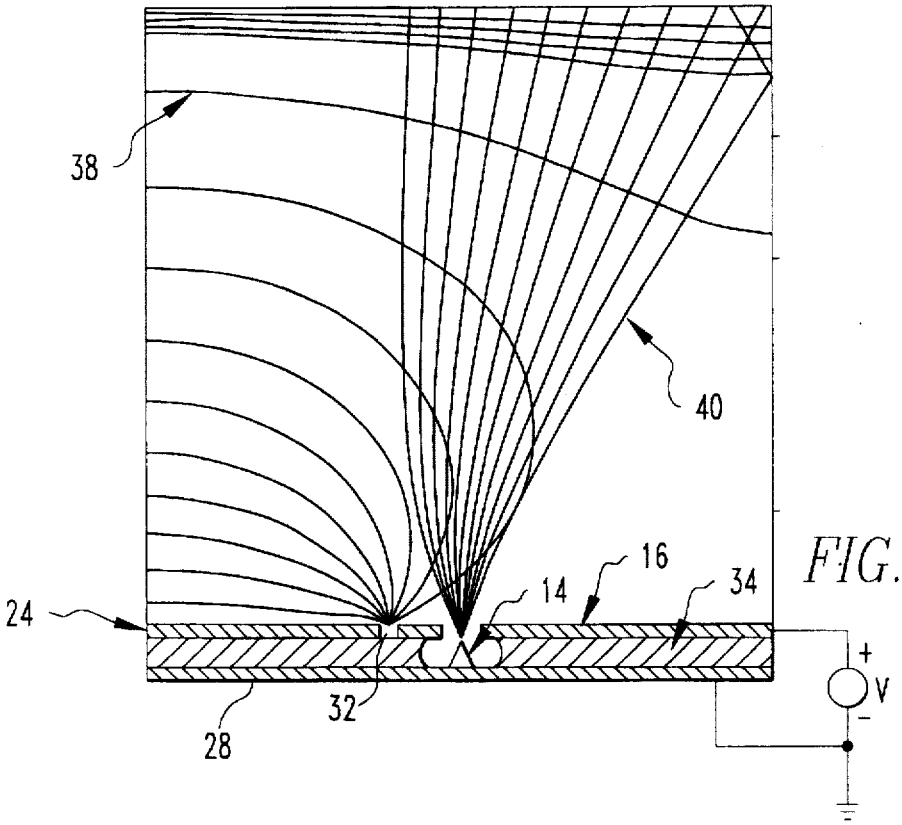
FIGS. 3*a*–3*d* are schematic representations showing electron trajectories of the various embodiments with focusing from one side.
Figure 3B:
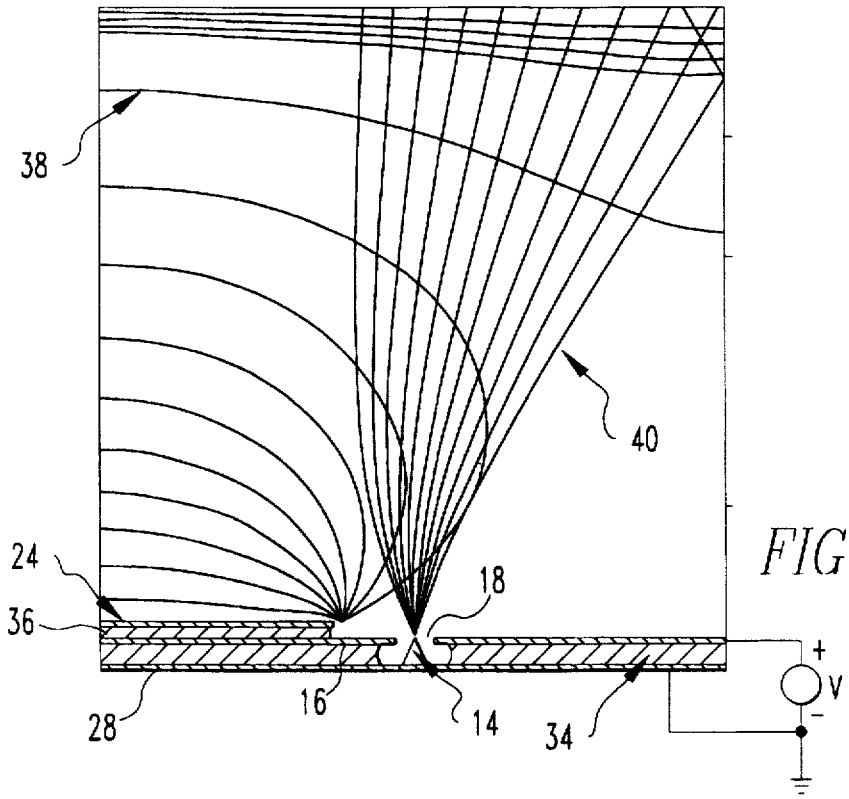
Figure 3C:
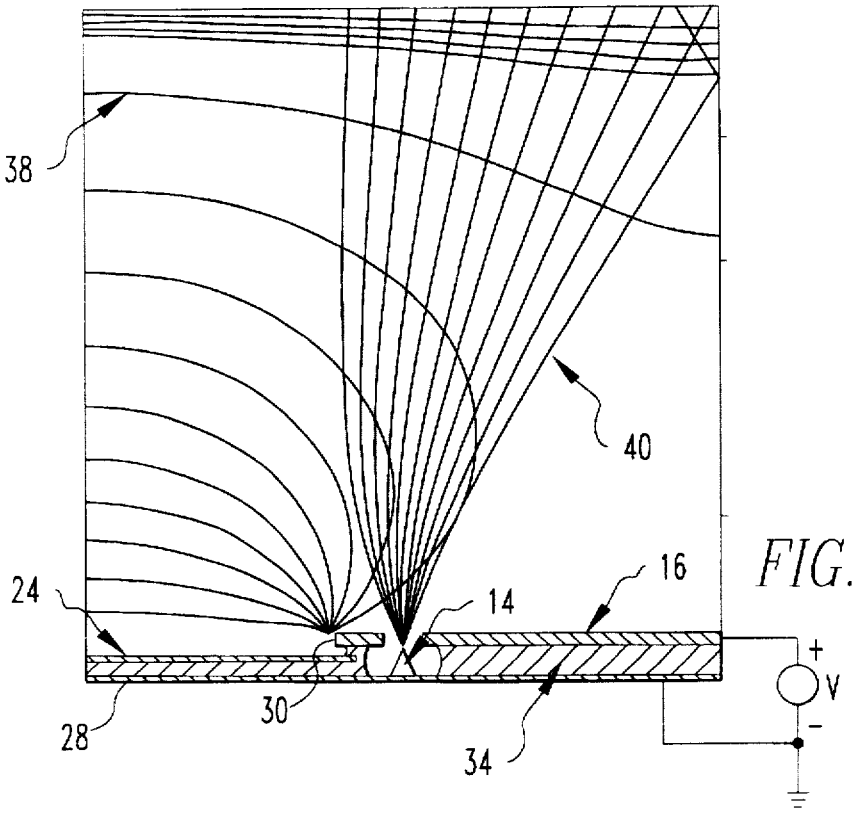

The planar lens electrode 24 can be on one side of the grid opening 18 for edge focusing. The various embodiments with edge focusing showing equal potential lines 38 and electron trajectories 40 are shown in FIGS. 3*a*–3*c*.

Figure 4A:
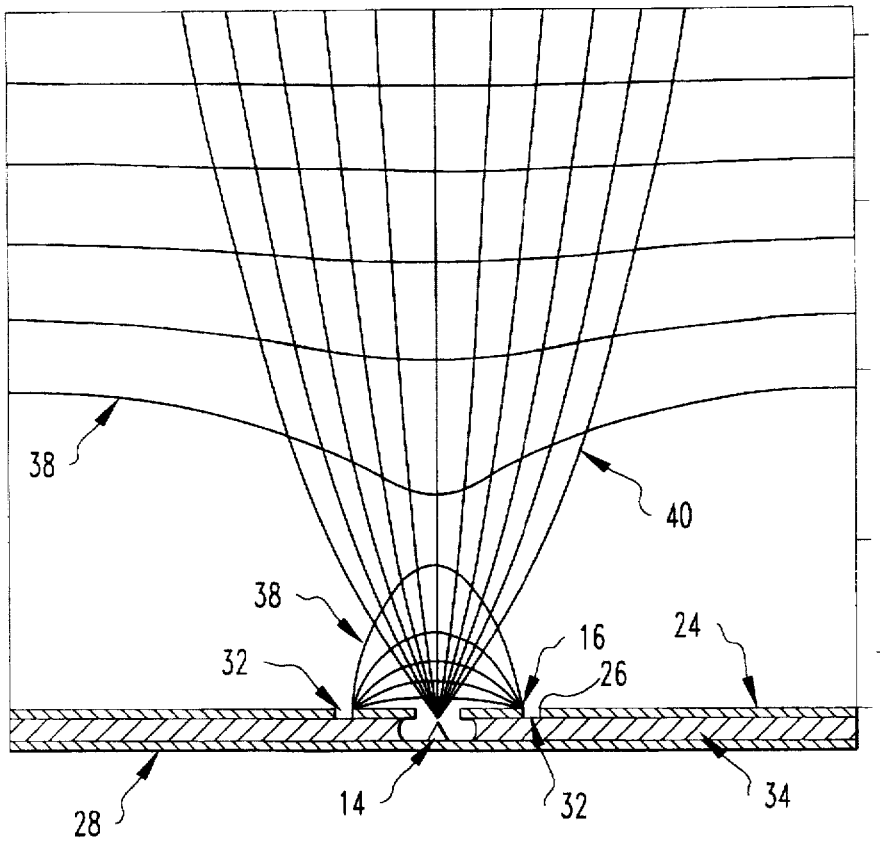
FIGS. 4*a*–4*d* are schematic representations showing electron trajectories of the various embodiments with focusing from two sides.
Figure 4B:
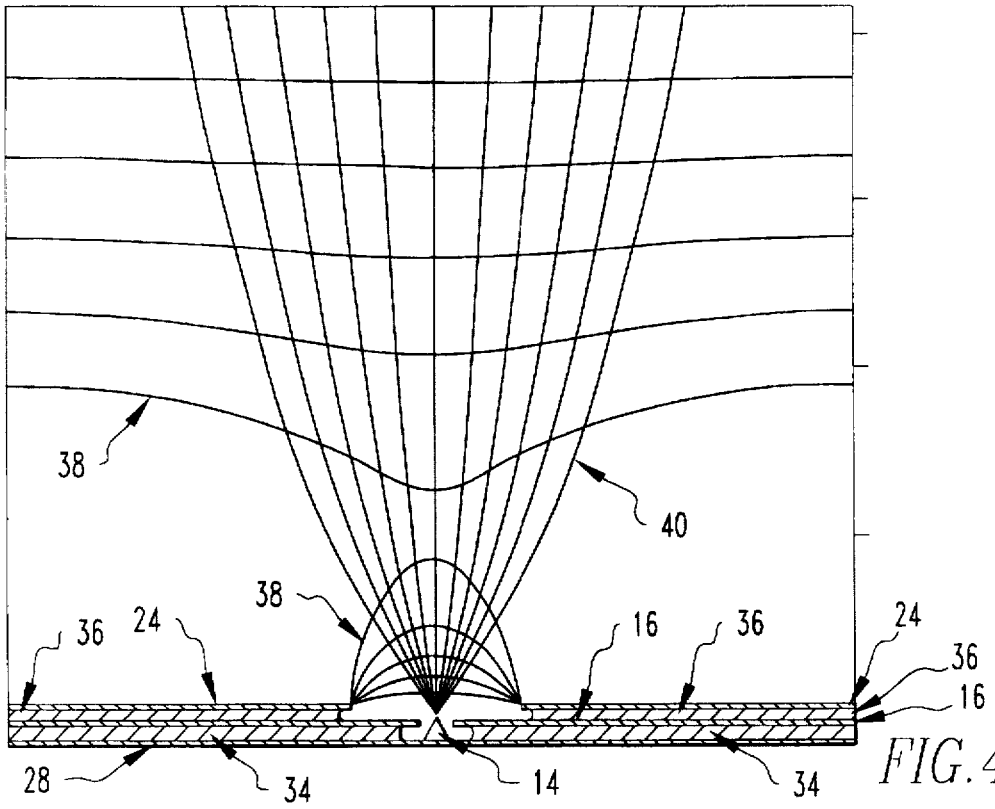
Figure 4C:
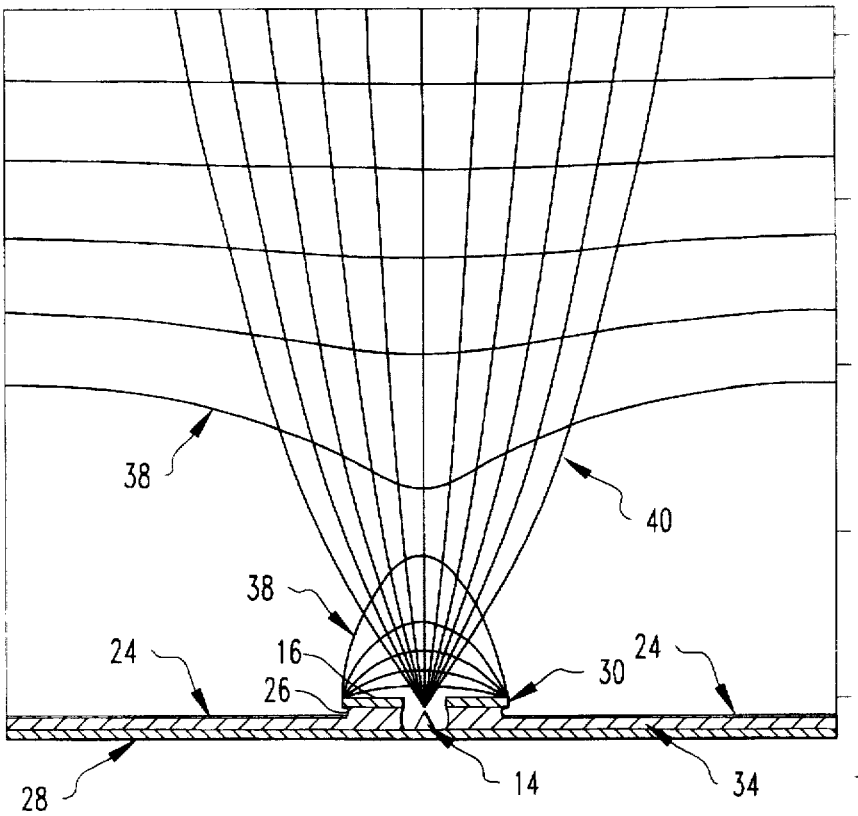

The planar lens electrode 24 can also surround the grid opening 18, as shown in FIGS. 4*a*–4*c*. For instance, the lens edge can be defined by an opening of the planar lens electrode. The opening surrounds and is larger than the grid opening 18.

The gated field emission array 12 can comprise an array of field emitting tips 14 and an associated array of grid openings 18. There can be one lens per tip or a plurality of field emitting tips 14 and grid openings associated with each integrated planar lens 24.

Figure 2D:
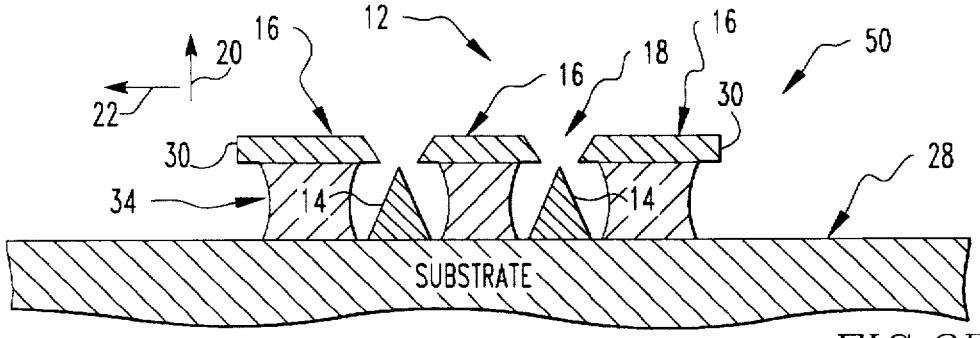
Figure 3D:
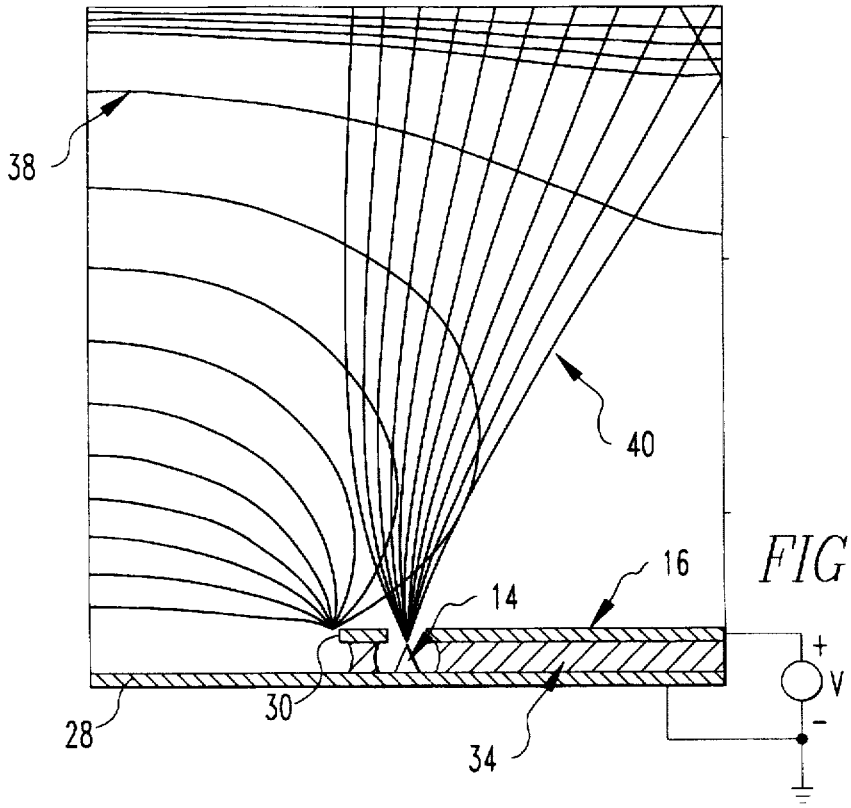
Figure 4D:
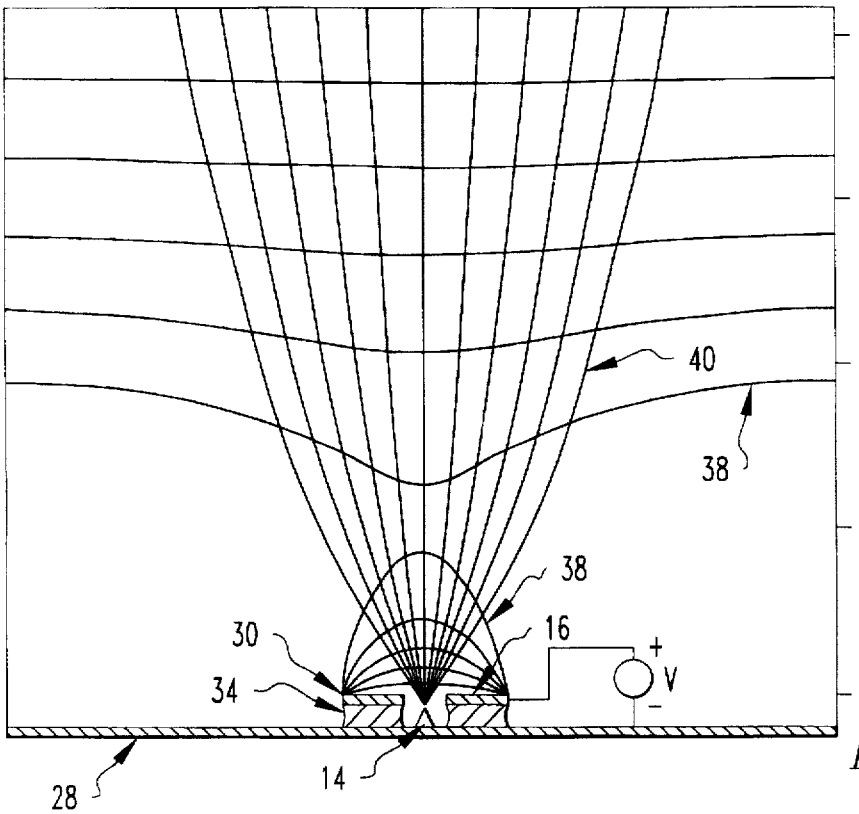

A unit of the invention consists of a gridded FEA 12, where the grid is surrounded by a lower voltage electrode 24. The beam confinement field only affects electrons emitted from tips near the edge of the grid electrode 16. The grid 16 of the FEA can be fabricated in any geometrical shape (circle, square, wedge, etc.). The planar lens electrode 24 is then fabricated in close proximity to (and therefore congruent in shape with) the FEA grid 16, but electrically isolated from it by a gap sufficient to withstand the voltage difference between them. In FIG. 2*a*, the grid electrode 16 and the lens electrode 24 are on the same layer and separated by a gap 32 of vacuum. In FIG. 2*b*, the planar lens electrode 24 is above the grid electrode 16, separated by an insulative material 36. Similarly, in FIG. 2*c*, the planar lens electrode 24 is below the grid electrode 16, and separated by an insulator material 34. Sometimes, the base electrode 28 on which the tips 14 are formed can act as a lens, as shown in FIGS. 2*d*, 3*d* and 4*d*. This unit of invention can be repeated either in the transverse or lateral dimension, or both.

Configured in any of the above ways, the planar lens 24 modifies the electric field at the edges of the FEA 12, as demonstrated by the equipotential curve 38 and electron trajectories 40 of two configurations by focusing from one side as shown in FIGS. 3*a*–3*d* and focusing along two sides as shown in FIGS. 4*a*–4*d*. The field at the boundary between electrodes can provide focusing for electrons emitted near the edge of the array 12. The extent of the focusing field is on the order of tens of microns. The strength of the focusing field is dependent on the voltage difference between the lens electrode 24 and grid electrodes 16.

Figure 5:
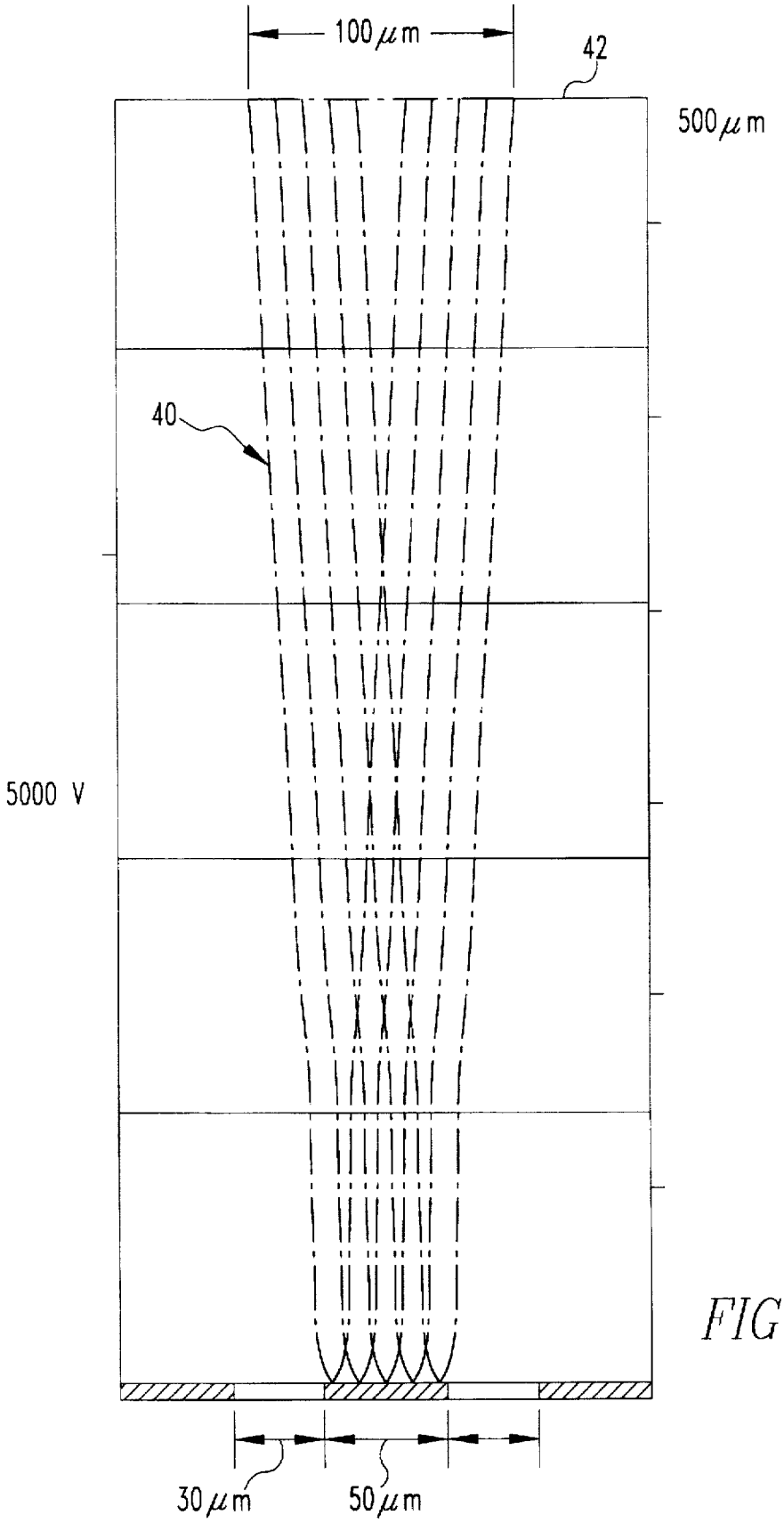
FIGS. 5 is a schematic representation showing electron trajectories focused by a planar lens relative to display parameters.

An example of the planar lens electrode 24 on the same layer as the grid electrode 16 is shown in FIG. 5, where the grid electrode is 50 μm wide and separated from neighboring grid electrodes by 30 μm wide gap. The voltages at the grid 16, the tip 14 and the planar lens 24 are 90 V, 0 V and −50 V, respectively. The anode 42 is 500 μm away, with an applied voltage of 5000 V.

Figure 6:
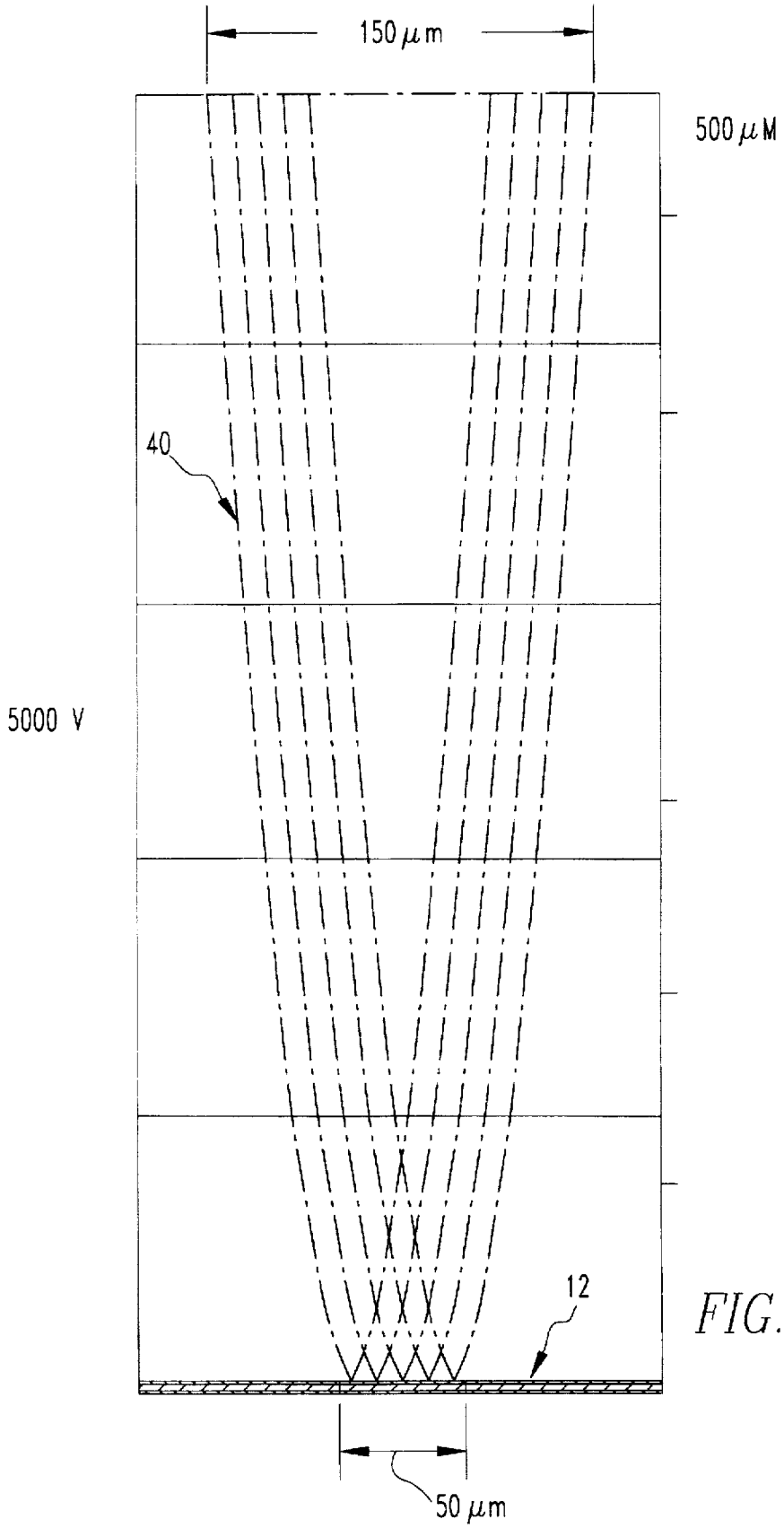
FIG. 6 is a schematic representation showing electron trajectories relative to display parameters without focusing.

The electrons emerge from the grid opening 18 with initial angles within ±25. The spot size at the anode is 100 μm with the planar lens, as shown in FIG. 5. Without the planar lens, the spot size is 150 μm, as shown in FIG. 6.

It should be appreciated that planar lenses can be used in conjunction with other types of electrostatic lenses to provide additional focusing. For example, linear sidewall lenses focus only in one direction (along the width). Planar lenses 24 can be used at either or both ends to provide focusing in the direction for which linear sidewall lenses have no focusing.

The operation of the planar lens 24 requires application of appropriate voltages to the various electrodes of the device, fabricated according to design. A voltage is applied to the grid electrode 16, $V_g$, to extract electrons from the emitter tip 14. This voltage is typically 30–300 volts above the voltage at the tip of the emitter 14, $V_t$, which is taken to be ground. The invention can be operated by applying the appropriate voltage, $V_L$, to the planar lens electrode 24, with $V_g > V_L$.

As shown in FIGS. 2*d*, 3*d* and 4*d*, a focusing effect can be induced simply by having an edge adjacent to the grid opening 18. The edge 30 can be formed by the grid electrode 16.

FIG. 4*d* illustrates the beam confinement concept for emitters inside a narrow strip of grid electrode 16. The grid electrode 16 is 20 μm wide. The voltage of the grid electrode is 150 V. On either side of the grid electrode, the potential is 0 V. The anode, located 100 μm from the emitters, is held at 156 V. The electron trajectories at the anode with the focusing effect of the substrate acting as a planar lens is shown.

FIG. 3*d* illustrates beam confinement along the edge of a grid electrode 16. An emitter is located 10 μm to the right of the edge of a grid electrode 16. The voltage of the grid electrode is 150 V. To the left of the grid electrode 16, the potential of the substrate is 0 V.

Thus, as shown in FIGS. 2*d*, 3*d* and 4*d*, the present invention is also a gated field emission device 50 comprising a base electrode 28 and at least one field emission tip 14 disposed on the base layer 28. There is a grid electrode 16 having an opening 18 disposed over the emission tip 14 in a first direction 20. The grid electrode 16 has at least one edge 30 disposed aside in a spaced relation to the grid opening 18 in a second direction 22 perpendicular to the first direction 20 which by influence of voltage on the base layer 28 induces a focusing effect on electrons emitted by the emission tip 14.

Preferably, there is an insulator 34 integrally disposed between the grid electrode 16 and the base electrode 28.

The potential difference along the edge 30 affects the electric field and causes the electrons to deflect away from the edge 30 of the grid electrode 16. This edge effect focusing of FEAs was discovered after experimenting with 1×100 and 2×100 arrays. The FEAs used in the experiment are fabricated by MCNC. These FEAs are processed from silicon wafers, with the emitting tips on pyramids supported by mini-columns, similar to those reported in H. H. Busta, D. W. Jenkins, B. J. Zimmerman and J. E. Pogemiller, Technical Digest of the 1991 IEEE IEDM Meeting, pp. 213–215. The grid opening diameters are~1.1 μm. The smaller grid opening diameter allows a higher packing density than was possible with the previous 2 μm diameter MCNC silicon FEAs (G. W. Jones, C. T. Sume and H. F. Gray, IEEE Trans. on Components, hybrids and Manufacturing Tech., vol. 15, pp. 1051–1055; H. F. Gray, G. J. Campisi and R. F. Greene, Technical Digest of the 1986 IEEE IEDM, pp. 776–779).

In the experiment, each chip contained 5 devices: two single tips, two 1×100 arrays and one 2×100 array. The grid thickness was between 0.5–0.7 μm. Emitter patterns from two different mask designs were tested. (i) Mask set 1: The tip-to-tip separation is 8 μm. The total width of the grid electrode was 10 μm. The emitter array was located at the center of the grid electrode. The grid electrodes of the 2×100 arrays are separated by a gap of 10 μm. (ii) Mask set 2: For the 1×100 arrays, the tip-to-tip separation was 20 μm and the total width of the gate electrode was 40 μm. For the 2×100 array, the tip-to-tip separation was 20 μm in both directions and the total width of the grid electrode is 60 μm. The edge of the grid electrode was 20 μm to either side of the emitter arrays.

Figure 7:
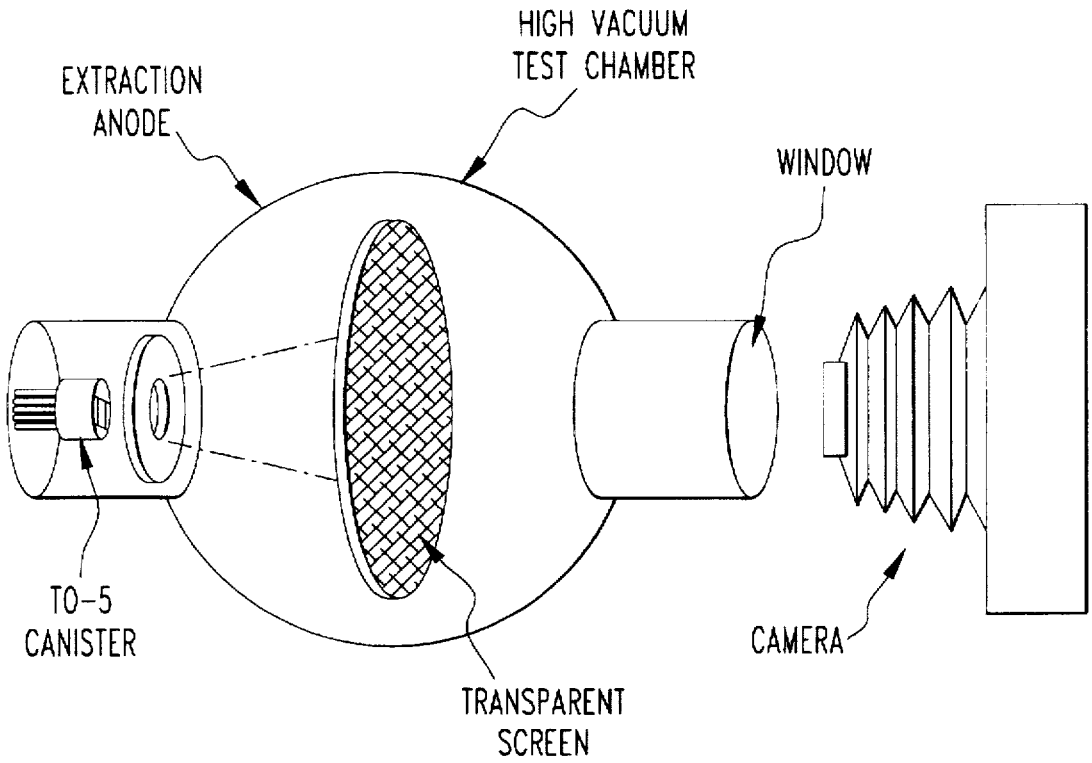
FIG. 7 is a schematic representation showing an experimental set-up for determining electron beam trajectories.

Testing was performed using an electron gun in an UHV chamber that projects electrons emitted from the FEA onto a distant phosphor screen, shown in FIG. 7. The details are given below.

The FEA chips were mounted using conductive silver epoxy onto 8-pin TO-5 canisters. A TO-5 canister was then inserted into a test fixture consisting of a machined ceramic socket and an electrostatic Einzel lens. The lens was fixed at a distance of approximately half an inch from the centered chip and maintained at 300 Volts. The fixture was mounted in one port of a small UHV chamber, facing a phosphor screen held at 900 Volts. Data was collected using a non-transmitting phosphor screen placed at a 45° angle to the electron beam. Later the vacuum chamber was reconfigured to use a transparent 3 inch sapphire/phosphor/aluminum screen from Raytheon, Inc., placed perpendicular to the electron beam trajectory, shown in FIG. 7. The new screen did not have the image distortion of the non-transmitting screen, which resulted from the 45° observation angle. With the phosphor screen, it was able to detect trajectory information in addition to voltage-current data. All chips are tested at around $1\times10^{-8}$ Torr after two to three hours of baking at 100° C.

Current to the screen was monitored by measuring the voltage drop across a load resistance between the screen and voltage source (with one leg of the voltage tied to ground). The total currents going to the tips, as well as grid current, were monitored using load resistances.

To test a device on a chip, the gate to that device was connected to ground, while a variable negative voltage was applied to the chip substrate. In order to prevent other devices not being tested from emitting, their gates were shorted to the chip substrate 28 so that there will be no potential difference.

Figure 8:
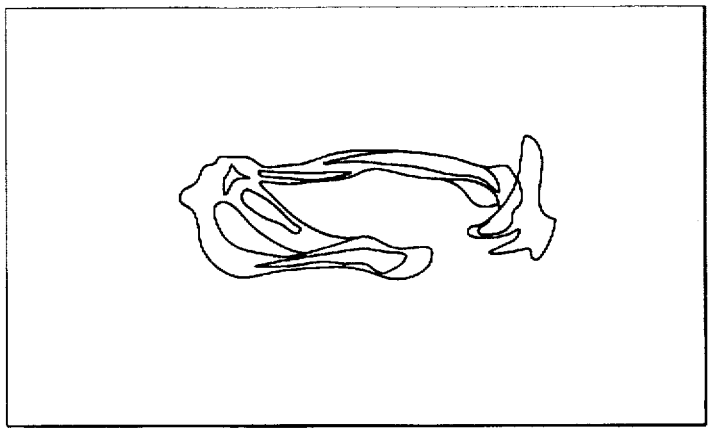
FIG. 8 is an emission pattern at low emission currents.
Figure 9:
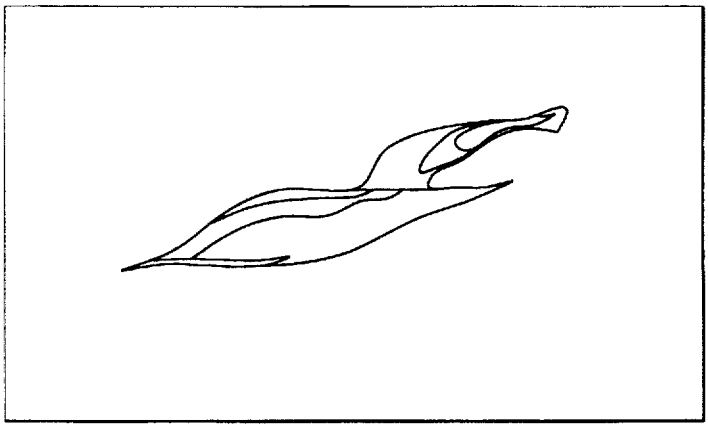
FIG. 9 is an emission pattern at higher emission currents.
Figure 10:
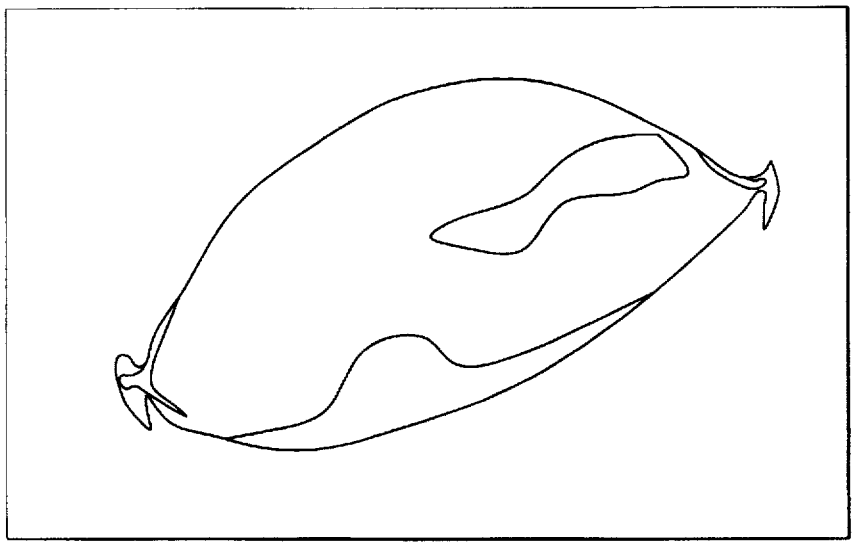
FIG. 10 is an emission pattern at highest emission currents.
Figure 11:
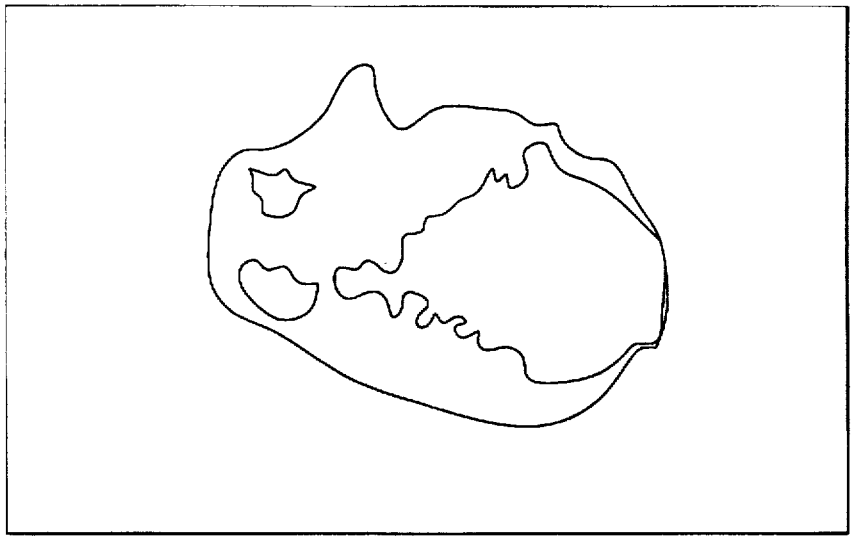
FIG. 11 is an emission pattern of 2×100 array.

Initially, emission patterns from 1×100 and 2×100 on screen were expected to be close to circular. However, elongated emission patterns were observed. At low emission currents, one or two thin small, slightly twisted images appear on the phosphor screen. Typically, the length of these filaments were more than 10 times their width, as shown in FIG. 8. We attribute each of these images to a single emitting tip. As current increases, the images become brighter and develops into football shapes, as shown in FIG. 9. As more tips emit and current increases, the images from the 1×100 arrays merge into a single large football shape with increasing brightness, as shown in FIG. 10. In the 2×100 arrays of mask set 1, two distinguishable football images were observed, each attributed to an individual 1×100 array, as shown in FIG. 11. FIGS. 9 and 10 were obtained using the transmitting phosphor screen, while FIGS. 8 and 11 were obtained with the reflecting phosphor screen. The football shaped images from 1×100 arrays of both mask sets are roughly the same.

Figure 12:
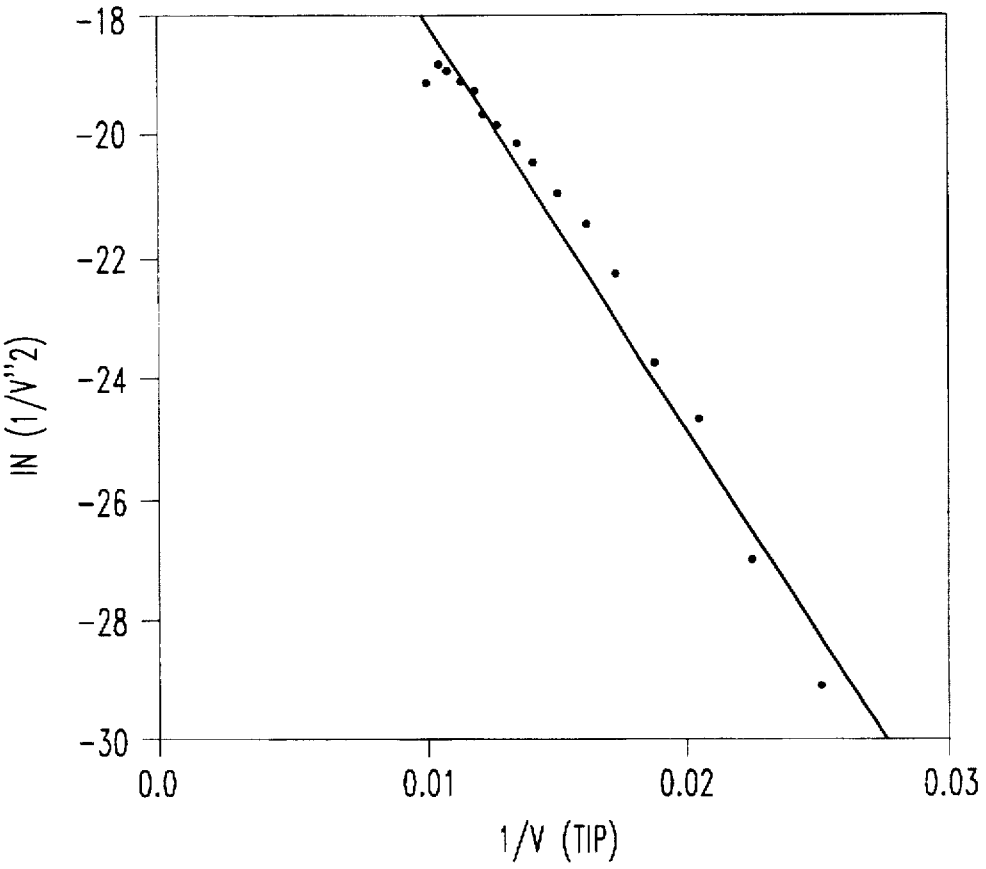
FIG. 12 is a graph illustrating voltage data for a 2×100 array.

The 2×100 array began to emit at a tip voltage of −66.9 V with a "second turn-on" voltage of −40 V. The maximum screen current obtained was 70 μA at tip voltage of −100.2 V. The voltage-current data for this array is shown in FIG. 12. At total current below 10 μA, the image on screen was a roughly rectangular patch approximately 1 inch long, with two bright, straight, parallel line segments forming the sides, and many fainter filamentary structures visible inside, which we interpret as images of individual tips emitting. At higher currents (50–70 μA), the images became two football shaped patches, overlapping each other, but slightly offset, as shown in FIG. 11.

Figure 13:
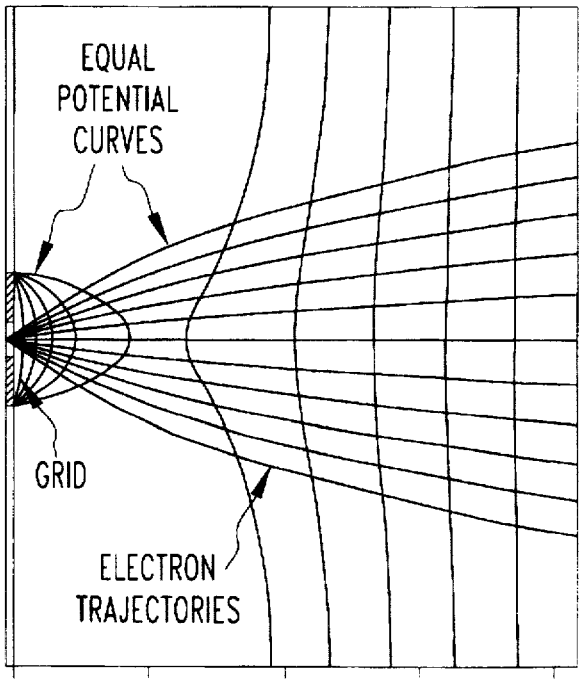
FIG. 13 is a schematic representation showing beam confinement induced by focusing effects at the edge of the grid electrode.
Figure 14:
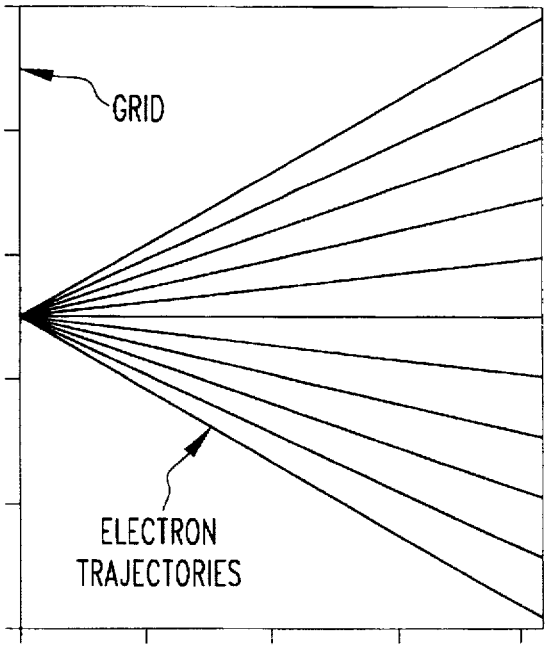
FIG. 14 is a schematic representation showing electron trajectories without focusing.

These experiments showed that electron beam trajectories far from field emitters are influenced not only by electric field formed between emitter and grid, but by other fields in proximity to the emission site. It was discovered that the field formed along the edge of the grid electrode due to an adjacent lower voltage potential can act as a focusing lens. This situation is exactly that of the narrow strip gate electrode of 1×100 array surrounded by the lower voltage base electrode. The equipotential lines and the electron trajectories simulated by EGUN2 (W. B. Herrmannsfeldt, EGUN—An Electron optics and Gun Design Program, SLAC Report 331 (1988)), shown in FIG. 13, illustrate beam confinement for emitters inside a narrow strip of gate electrode. The electrons are assumed to be emitted with half angle up to 30°. The gate electrode is 20 μm wide. The voltage of the gate electrode is 150 V. On either side of the gate electrode, the potential is 0 V. The anode, located 100 μm from the emitters, is held at 156 V. The electron trajectories without the focusing effect is shown in FIG. 14.

These experiments demonstrated experimentally and theoretically a simple method of producing focusing for arrays of field emitters without the fabrication of additional focusing electrodes. The focusing mechanism results from fringe fields formed at the edge 30 of the grid electrode 16 due to it being at a higher potential than its surroundings. This principle can be applied in a variety of configurations.

The application requirement of the FEA determines the final design. The following parameters are important: i) the spot size of the electrons at the anode, ii) the distance between the anode and grid and iii) the anode voltage. The design considerations are:

i) the size and shape of the grid 16,
ii) the size and shape of the planar lens 24,
iii) the voltages of the grid 16 and the planar lens 24,
iv) the best method of fabricating the planar lens 24 and the FEA,
v) the current density desired and
vi) the best type of emitter technology, i.e., Si emitters, metallic emitters, eutectic emitters, cones, edges, etc. In practice, the design considerations often alter the initial desirable specifications.

Currently, the dominant potential application for FEAs is in the area of flat panel displays. The pixel size of a field-emission display without lenses would be large, as described in Section II. The advantages of the application of this lens to the display are the ability to:

i. reduce pixel sizes,
ii. increase brightness of the pixels by increasing the number of emitting tips for each pixel and/or
iii. reduce the impact of electrons on spacers, which separates the phosphor and the emitters.

The planar lens electrode 24 can reduce back ion bombardment on the emitters 14, where the ions were produced at the anode. Following the field lines, the ions will go to the low voltage planar lens 24. Impact of ions on the lens 24 is not as detrimental as on the emitter tip 14. Planar lenses are simple and relatively inexpensive to fabricate and are insensitive to variations in fabrication. The devices 10 and 50 can be processed with many emitters over large areas. The devices 10 and 50 can be processed on the same wafer or substrate.

There is also no high voltage gradient in the devices 10 and 50. A voltage gradient less than 250 V/μm in the insulator 34 is sufficient for focusing. Insulator material that can sustain this kind of voltage gradient over large areas is readily available. Also, there is no high voltage near the emitter tip 14. This reduces the chance of secondary electron production and back ion bombardment.

Quite simply, the advantage of using planar lens for FEAs to produce collimated beams is the feasibility and simplicity of producing spatial and temporal modulation.

Utilizing FEAs in conjunction with planar lenses as electron guns, extremely compact, low power radiation sources are possible in the infrared, optical and x-ray regimes.

The concept of the invention remains the same, independent of the following:

1) Variations in the shape of the planar lens 24.
2) Variations in the height (with respect to FEA gate), thickness and voltage.
3) Materials used in the fabrication of the device.
4) Fabrication method.
5) The layout of the emitter tips 14 pattern inside the planar lens 24.
6) The concept can be applied to a single emitter 14 (micro planar lens) or to a large group of emitters 14 (macro planar lens).

This collimation concept can be applied alone or in conjunction with other focusing mechanisms. For example, when the planar lens is applied alone, edge focusing will produce pixel sizes of a few tens of μm or larger. For smaller pixel sizes, this concept is most useful when it is applied with other lens designs:

i) to reduce the alignment tolerance requirement of the other lens,
ii) to focus the beams at the end of linear sidewall lenses,
iii) to simplify the processing of other lenses, etc. We will explore the various possibilities.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A device for producing collimated electron beams comprising:

a base electrode;

more than one field emission tip disposed on the base electrode;

a grid electrode having a plurality of grid openings one disposed over each field emission tip in a first direction, said grid electrode having at least one edge disposed aside in a spaced relation to the grid openings in a second direction perpendicular to the first direction and which by influence of voltages on the base electrode, grid electrode and an anode electrode induce a focusing effect on electrons emitted by the emission tips; and an anode electrode disposed adjacent the grid electrode in regard to the first direction.

2. A gated field emission device as described in claim 1 including an insulator integrally disposed between the grid electrode and the base electrode.

3. A device as described in claim 1 wherein the planar lens is an integrated layer with the gated field emission array on a substrate.

4. A device as described in claim 3 wherein the grid electrode layer has a grid edge disposed in a spaced relation to the grid opening in the second direction, said lens edge disposed adjacent to said grid edge.

5. A device as described in claim 4 wherein the planar lens electrode and the grid electrode are disposed on a same layer such that a space is formed between the grid edge and the lens edge.

6. A device as described in claim 5 wherein said same layer comprises an insulator layer.

7. A device as described in claim 4 wherein the planar lens electrode is disposed in a spaced relation to the grid electrode relative to the first direction.

8. A device as described in claim 7 wherein the planar lens electrode is separated from the grid electrode by an insulative layer.

9. A device as described in claim 4 wherein the planar lens electrode is disposed below the grid electrode relative to the first direction.

10. A device as described in claim 9 wherein the planar lens electrode is separated from the grid electrode by an insulator layer.

11. A device as described in claim 4 wherein the lens edge is defined by a lens opening of the planar lens electrode, said lens opening surrounding and larger than said grid opening.

12. A device as described in claim 11 wherein the gated field emission layer comprises an array of field emitting tips and an associated array of grid openings.

13. A device as described in claim 12 wherein there is a plurality of field emitting tips and grid openings associated with each integrated planar lens opening.

14. A device for producing collimated electron beams comprising:

a base electrode;

a gated field emission array having a plurality of field emission tips disposed on the base electrode, and a grid electrode having a plurality of openings with one opening disposed over a respective one of the field emission tips in a first direction, said grid electrode having at least one edge disposed aside in a spaced relation to the grid openings in a second direction perpendicular to the first direction;

an anode electrode disposed adjacent the grid electrode in regard to the first direction; and an integrated planar lens electrode for producing a focusing effect on electron beams emitted by the field emission tips, said planar lens electrode having a lens edge disposed aside at a distance from the grid edge in a second direction perpendicular to the first direction and which by influence of voltages of the lens electrode, grid electrode and the anode electrode induce a focusing effect on electrons emitted by the emission tips.

* * * * *